US007351926B2

(12) United States Patent
Hillman

(10) Patent No.: US 7,351,926 B2
(45) Date of Patent: Apr. 1, 2008

(54) ROTATION-PROOF ENCLOSURE FOR PRESSURE SWITCH HOUSING

(76) Inventor: Kenneth Brad Hillman, P.O. Box 4172 PPSE, Edmonton, Alberta (CA) T6E 4T3

( * ) Notice: Subject to any disclaimer, the term of this patent is extended or adjusted under 35 U.S.C. 154(b) by 134 days.

(21) Appl. No.: 11/419,167

(22) Filed: May 18, 2006

(65) Prior Publication Data

US 2007/0064769 A1 Mar. 22, 2007

(30) Foreign Application Priority Data

May 18, 2005 (CA) ..... 2507720

(51) Int. Cl.
*H01H 35/24* (2006.01)

(52) U.S. Cl. ..... 200/81 R; 200/82 R

(58) Field of Classification Search ..... 200/81 R, 200/82 R, 82 C, 83 B, 83 J, 83 P, 83 V, 83 W
See application file for complete search history.

(56) References Cited

U.S. PATENT DOCUMENTS 3,619,526 A * 11/1971 Riley ..... 200/83 J
3,787,650 A * 1/1974 Lewis ..... 200/61.04
4,438,305 A * 3/1984 Johnson ..... 200/83 J
4,762,972 A * 8/1988 Roeser ..... 200/302.1
5,554,834 A * 9/1996 Ellett ..... 200/82 A
5,670,766 A * 9/1997 Ellett ..... 200/83 J
5,744,771 A * 4/1998 Ellett ..... 200/83 J
6,006,600 A * 12/1999 Cheng ..... 73/146.5
6,410,870 B1 * 6/2002 Nishizaki et al. ..... 200/83 R
6,621,021 B2 * 9/2003 Pechhold et al. ..... 200/83 A
6,803,532 B1 * 10/2004 Lee ..... 200/6 A
2003/0102203 A1 * 6/2003 Pechhold et al. ..... 200/83 A
2006/0086600 A1 * 4/2006 Hillman ..... 200/343

* cited by examiner

*Primary Examiner*—Elvin Enad
*Assistant Examiner*—Lisa Klaus
(74) *Attorney, Agent, or Firm*—Dennis T. Griggs

(57) ABSTRACT

A housing for a pressure switch is coupled to a pipeline. The housing has a tubular body with an explosion-proof enclosure attached to the body with a retainer sleeve inserted through an opening in the enclosure and threaded into the body to secure the enclosure to the body in an axial direction. The body of the housing may be coupled to the pipeline via an interstitial trim device. The body and trim are preferably coupled together using left-hand threads. The enclosure is further secured to the body by a pin that extends from the enclosure into a corresponding pin receptacle in the body. The pin opposes rotation of the enclosure with respect to the body and prevents attempts by field personnel to remove the pressure switch from a pipeline by simply turning the enclosure. This arrangement also avoids disruption of the calibration of micro-switch components contained within the enclosure. In addition, the left-hand threads in the junction between the body and the trim keep the body from being loosened from the trim.

18 Claims, 6 Drawing Sheets

ROTATION-PROOF ENCLOSURE FOR PRESSURE SWITCH HOUSING

CROSS-REFERENCE TO FOREIGN PRIORITY APPLICATION

This application claims priority from Canadian Application No. 2,507,720 filed May 18, 2005.

FIELD OF THE INVENTION

The present invention is related to the field of pressure switches for sensing the pressure of hydrocarbons flowing through a pipeline. Specifically, the present invention is related to rotation-proof enclosures for pressure switch housings.

BACKGROUND OF THE INVENTION

In pipelines carrying liquid hydrocarbons flowing at high pressure, it is known to use a monitoring device mounted externally on the pipeline to sense the pressure of the fluids flowing through the pipeline. If the pressure of the fluids flowing through the pipeline becomes excessive due to freezing of the pipeline during winter conditions or to waxing off, the pipeline may burst. Accordingly, it is known to use pressure cut-off switches mounted on the pipeline whereby the pressure of the fluids can be directly monitored.

The cut-off switches are designed such that when the pressure of the fluids exceeds a predetermined threshold, a diaphragm in the pressure switch housing is deflected by a predetermined amount. This diaphragm is typically operatively connected to a rod that moves upon the deflection of the diaphragm such that it will contact a micro-switch contained in an explosion-proof enclosure that forms part of the pressure switch and trip the switch. The pressure switch can be configured to operate upon a predetermined high or low-pressure condition as well known by those skilled in the art. Tripping of the micro-switch then sends an electrical signal to either start up or shut down a motor or pump or send the signal directly to a control monitoring system that can alert the pipeline operators of a high or low-pressure condition.

Known pressure switch housings are typically manufactured having the explosion-proof enclosure threaded onto a body that forms part of the pressure switch housing. The enclosure is then further secured to the body with setscrews. It is important to keep the enclosure fixed to the body given that the activating rod within the enclosure travels a very small amount. This travel distance is typically in the range of fifteen-thousandths of an inch (0.015"). Over time, pressure switches may need to be repaired and are, therefore, removed from the pipeline to be repaired or, in other cases, simply removed to different locations on the pipeline itself.

When pressure switches are removed from a pipeline, the force used by field personnel to remove the enclosure, if excessive, may cause the enclosure to rotate with respect to the body. This may change the calibration of the micro-switch given that the actuating rod moves only a very small distance in order to operate the micro-switch. If the enclosure is sufficiently moved with respect to the body such that the micro-switch is moved beyond the actuation range of the actuator rod, the micro-switch may not operate. In this situation, the pressure switch will not detect a high or low-pressure condition.

It is, therefore, desirable to have an explosion-proof enclosure for a pressure switch where the explosion-proof enclosure will not move relative to the body of the pressure switch itself.

SUMMARY OF THE INVENTION

The present invention is a rotation-proof enclosure for a pressure switch used on a pipeline carrying fluid hydrocarbons under pressure. The present invention comprises a tubular body that is adapted at one end to couple to a pipeline. The body may have a threaded connection molded as part of it to thread into a corresponding receptacle on the pipeline. Alternatively, the body may have interchangeable interstitial thread-saving connection devices known as "trims" that allow the body to be coupled to various sizes of receptacles on pipelines. On the other end of the body, the body comprises an opening having internal threads. This threaded opening is adapted to receive a threaded sleeve that passes through a corresponding opening in an explosion-proof enclosure to thread into the body and secure the enclosure to the body. As the enclosure is not threaded onto the body, its axial position relative to the body will not change if the enclosure rotates about the retainer sleeve.

To prevent the enclosure from rotating with respect to the body, the enclosure comprises a pin extending towards the body that is received in a receptacle located on the end of the body. This receptacle can be simply a hole that receives the pin or it may be a machined slot to snugly receive the pin extending from the enclosure. The purpose of the pin is to keep the enclosure from rotating relative to the body should the retainer sleeve loosen to the point where the enclosure can rotate relative to the body.

Once the enclosure is secured to the body, the corresponding micro-switch can be installed in the enclosure with its position calibrated such that upon the diaphragm deflecting at its rated pressure, the corresponding travel of the actuating rod will activate the micro-switch.

Broadly stated, the present invention is a housing for a pressure switch, comprising: a tubular body for enclosing an actuating mechanism for said switch, said body having upper and lower ends and a passageway extending therebetween, said lower end adapted to couple to a pipeline, said upper end defining a first opening; an explosion-proof enclosure for enclosing a switch mechanism for said switch, said enclosure adapted to slidably fit onto said upper end of said body, said enclosure having a second opening that substantially aligns with said first opening when said enclosure is mounted onto said body; and anti-rotation means for preventing said enclosure from rotating on said body when said enclosure is fitted on said body, said anti-rotation means disposed between said enclosure and said body.

Broadly stated, another aspect of the present invention is a housing for a pressure switch, comprising: a tubular body for enclosing an actuating mechanism for said switch, said body having upper and lower ends and a passageway extending therebetween, said lower end adapted to couple to a pipeline, said upper end defining a first opening and having an interior sidewall, said interior sidewall having coupling means for coupling with a retainer sleeve; an explosion-proof enclosure for enclosing a switch mechanism for said switch, said enclosure adapted for mounting on top of said upper end of said body, said enclosure defining a second opening that substantially aligns with said first opening when said enclosure is mounted on top of said body; a retainer sleeve adapted to pass through said second opening into said first opening, said sleeve having an exterior sidewall with coupling means for securely coupling with said coupling means of said first opening and for securing said enclosure to said body, said sleeve having a passageway for said actuating mechanism to extend through from said body into said enclosure; and anti-rotation means for preventing said enclosure from rotating on said body when said enclosure is secured to said body by said retainer sleeve, said anti-rotation means disposed between said enclosure and said body.

DETAILED DESCRIPTION OF THE PREFERRED EMBODIMENT

Figure 1:
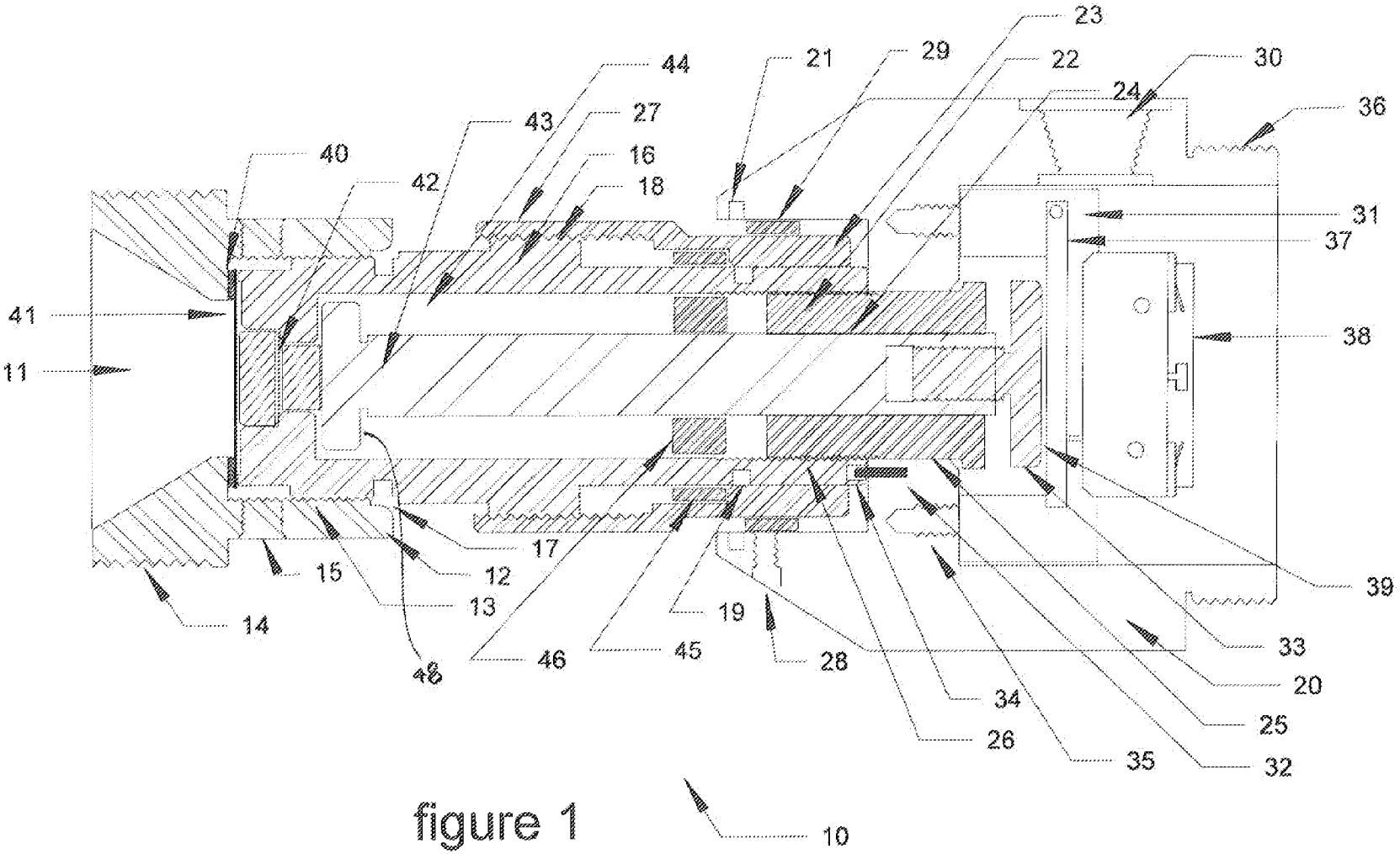
FIG. 1 is a cutaway, cross-sectional side elevational view of the preferred embodiment of the present invention.

Referring to FIG. 1, the present invention is shown. Housing 10 comprises of tubular body 16, trim 12, enclosure 20 and retainer sleeve 22. In one embodiment of the present invention, body 16 is threadably coupled to trim 12 at threaded connection 13. Trim 12 may be of different sizes so as to fit into standard sized threaded openings on pipelines. It will be known to those skilled in the art that body 16 and trim 12 can be molded as a single device. In an exemplary embodiment of the prevent invention, threaded connection 13 comprises left-hand threads. The use of left-hand threads prevents body 16 from spinning out of trim 12 should field personnel attempt to remove housing 10 from a pipeline by applying force to enclosure 20.

In the preferred embodiment as shown, body 16 comprises a groove 17 for installing an o-ring (not shown). This provides a seal in the connection between body 16 and trim 12. Setscrew holes 15 on the sides of trim 12 permit the installation of setscrews (not shown) to threadably lock trim 12 to body 16. Body 16 further comprises hex head 23, groove 19, collar 27 and mid-body threads 18. Hex head 23 permits the use of a wrench to tighten body 16 into trim 12. Groove 19 is used to house another o-ring seal (not shown).

Collar 27 is installed on body 16 by threading collar 27 onto threads 18. Collar 27 is used to adjust the position of bushing 46 to preset the tension of a spring (not shown) disposed within body 16. The spring rests between foot 48 of rod 43 and bushing 46. As collar 27 is turned about body 16, bushing 46 is either raised or lowered to lower or increase the spring's tension and, therefore, the pressure that the pressure switch will operate. Rod 43 is moved by piston 42 that is, in turn, moved by diaphragm 41 as fluids within the pipeline contact diaphragm 41. A seal 40 is placed between diaphragm 41 and trim 12 to ensure that no fluids enter into the interior volume of body 16. The o-ring that fits in groove 19 provides a seal between body 16 and collar 27.

Housing 10 further comprises explosion-proof enclosure 20 having passage-way 25. Retainer sleeve 22 is inserted through passageway 25 and attached to body 16 at threaded connection 26. Threaded connection 26 comprises threads on the interior sidewall of body 16 and exterior threads on retainer sleeve 22. It should be obvious to those skilled in the art that passageway 25 is sized to provide a snug fit with retainer sleeve 22 to center enclosure 20 on top of body 16. Enclosure 20 further comprises groove 21 that permits the insertion of a snap ring (not shown) to secure locking slip ring 29. The seal connection provided at groove 19 eliminates the need of having a seal between body 16 and enclosure 20. The position of collar 27 is secured by a setscrew (not shown) threaded into setscrew hole 28 and contacting locking slip ring 29 to secure collar 27 to a desired position on body 16.

To prevent enclosure 20 from rotating with respect to body 16, the present invention comprises anti-rotation means. The preferred embodiment of the anti-rotation means comprises of pin 32 and receptacle 34. Pin 32 extends from enclosure 20 to be securely and releasably seated in pin receptacle 34 located on the end of body 16. Pin 32 is of a sufficient length, as easily determined by those skilled in the art, embedded in enclosure 20 such that it will not loosen from enclosure 20 should field personnel apply force to enclosure 20 to remove housing 10 from a pipeline.

In the preferred embodiment of housing 10, body 16 is made of hardened steel whereas enclosure 20 is made of aluminum. Pin 32 is made of similar hardened steel as that of body 16 so as to provide a secure connection between pin 32 and pin receptacle 34 and to not widen or deform should field personnel apply force to enclosure 20 to remove housing 10 from a pipeline. Pin receptacle 34 may be a drilled hole or a slot machined just wide enough to accommodate pin 32. When retainer sleeve 22 is snugly threaded into body 16 at threaded connection 26, enclosure 20 is axially secured to body 16. Pin 32 fitting into pin receptacle 34 secures enclosure 20 in a rotational orientation with respect to body 16. While the preferred embodiment of the present inventions has pin 32 extending from enclosure 20 to fit into pin receptacle 32 on body 16, it should be obvious to those skilled in the art that pin 32 may extend from body 16 to a corresponding receptacle in enclosure 20.

Figure 2:
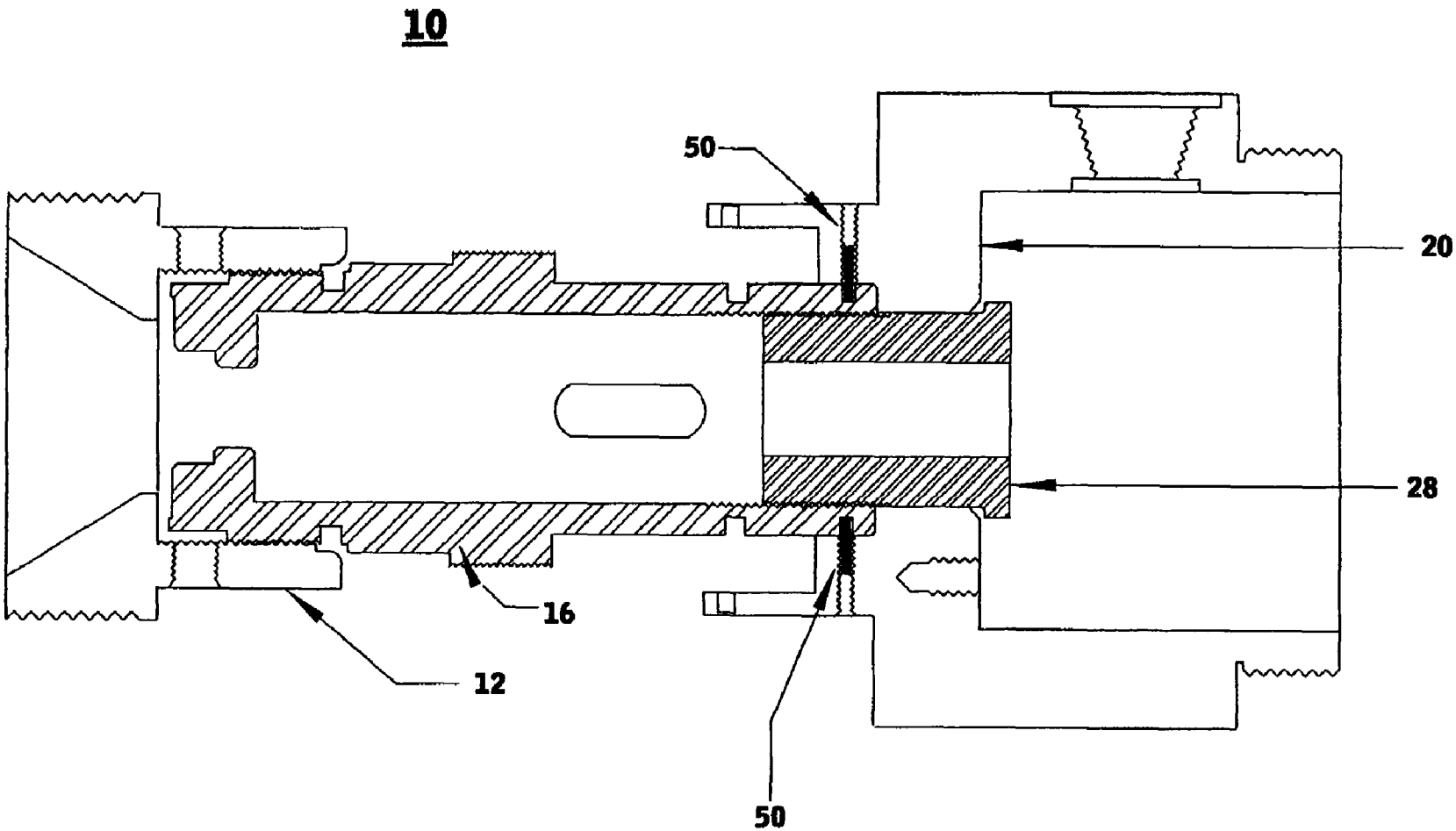
FIG. 2 is a cutaway, cross-sectional side elevational view of a first alternate embodiment of the present invention.
Figure 3:
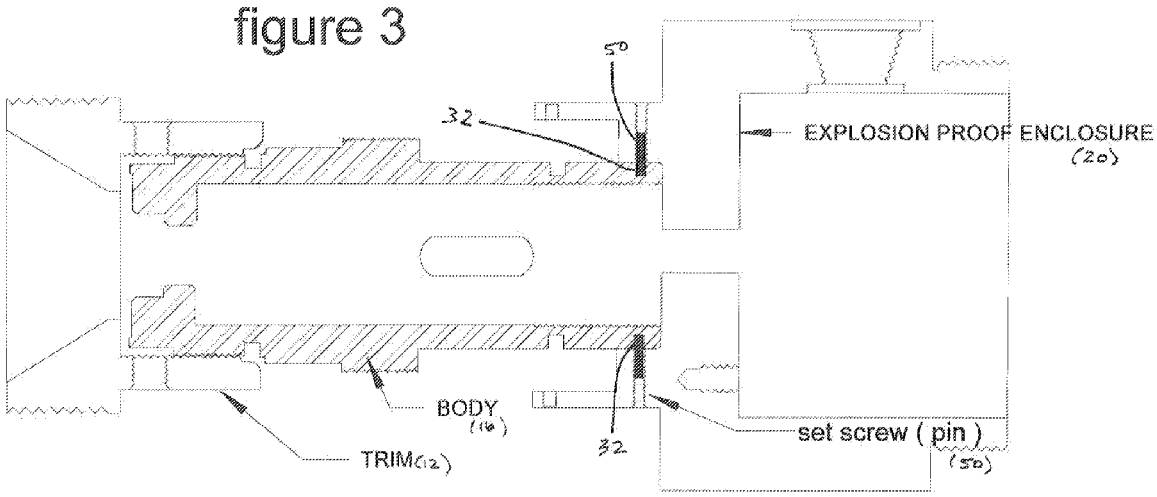
FIG. 3 is a cutaway, cross-sectional side elevational view of a second alternate embodiment of the present invention.

Referring to FIG. 2, a first alternate embodiment of the present invention is shown. In this embodiment, a pin or setscrew is threaded through the sidewall of enclosure 20 into pin receptacle 32 located on the side of body 16. Referring to FIG. 3, a second alternate embodiment of the present invention is shown. In this embodiment, retainer sleeve 25 is not used. The anti-rotation means comprises securing enclosure 20 to body 16 by setscrews 50 seated into pin receptacles 32.

Figure 6:
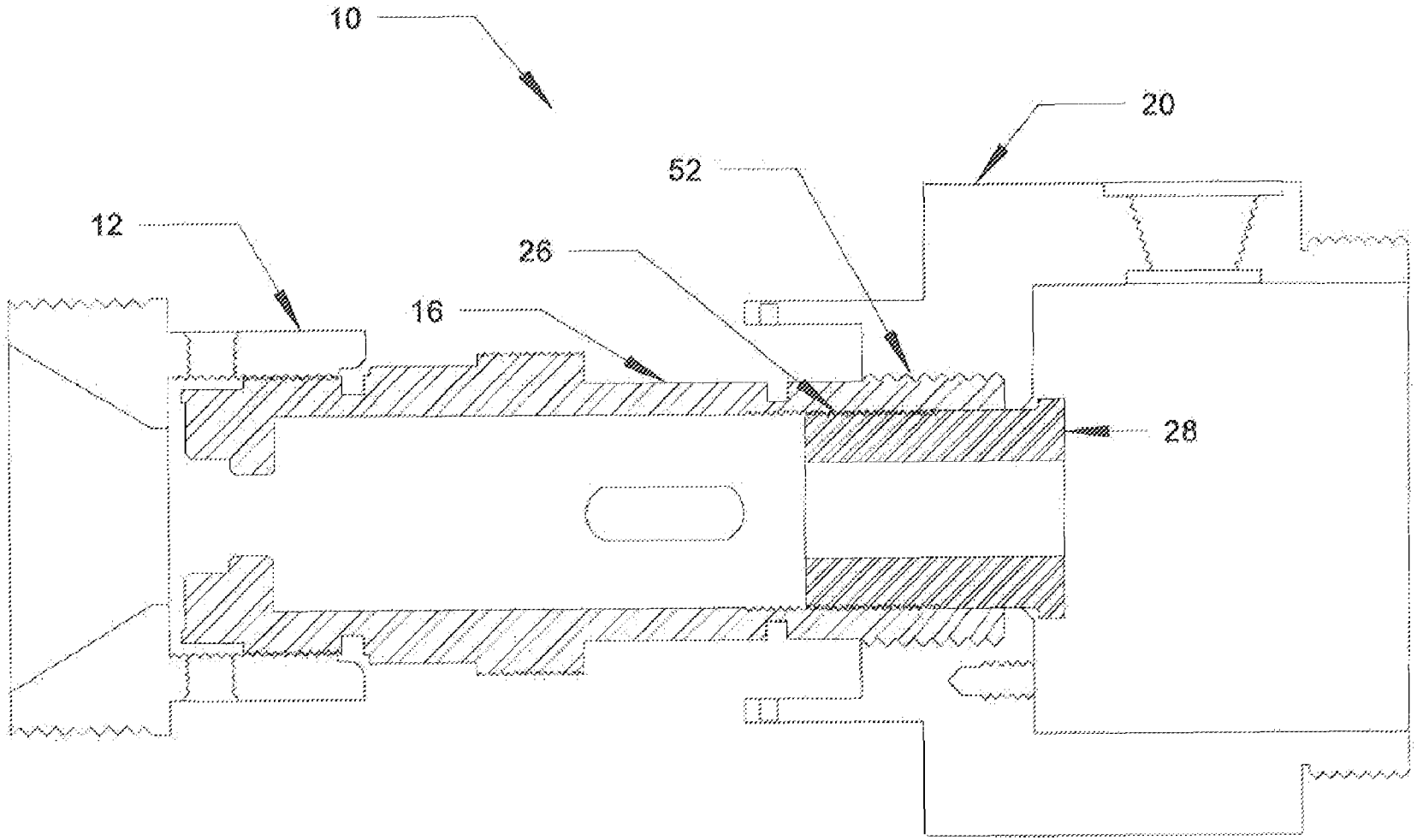
FIG. 6 is a cutaway, cross-sectional side elevational view of a third alternate embodiment of the present invention.

Referring to FIG. 6, a third alternate embodiment of the present invention is shown. In this embodiment of the present invention, the anti-rotation means comprises threading enclosure 20 onto the upper end of body 16 at threaded connection 52 in a direction that is opposite to the direction that retainer sleeve 22 is threaded into body 16 at threaded connection 26. As an example, enclosure 20 is threaded onto threaded connection 52 using left-hand threads whereas retainer sleeve 22 threads into threaded connection 26 using right-hand threads. Alternatively, enclosure 20 can use right-hand threads while retainer sleeve uses left-hand threads. In either case, when force is applied to enclosure to either install housing 10 onto a pipeline or to remove it, enclosure 20 is securely attached to body 16 thereby maintaining the calibration of the pressure switch as discussed in more detail below.

In each of the embodiments shown in FIGS. 1, 2, 3 and 6, micro-switch 38 is installed within enclosure 20 by fastening micro-switch 38 to micro-switch bracket 31 that is, in turn, fastened to enclosure 20 with screws threading into screw holes 35. The electrical connection to micro-switch 38 is provided a conduit connection threaded into connection opening 30 on enclosure 20. A cover (not shown) threads onto enclosure 20 at threads 36.

Housing 10 further comprises diaphragm 41 installed in diaphragm opening 38 of body 16 located between trim 12 and body 16. Rod 43 is placed within body 16 by passing through passageway 24 in retainer sleeve 22. Trip disc 33 is threadably attached to rod 43. Trip disc 33 is used to calibrate the correct gap 39 between trip disc 33 and trip lever 37. Trip lever 37 with its hinged lever action will increase the predetermined travel in the switch to a sufficient amount of travel to activate. Rod 43 extends from diaphragm 41 up through passageway 24 to micro-switch 38. Micro-switch 38 is positioned within enclosure 20 at a calibrated height above retainer sleeve 22 such that when the diaphragm is deflected at its rated pressure, the rod will move upwards through passageway 24 and activate the micro-switch. Typically, the rod will travel a distance of only 0.015" when the diaphragm deflects at its rated pressure. The electrical connection to the micro-switch is provided through a conduit connection threaded into connection opening 30 in enclosure 20.

Figure 4:
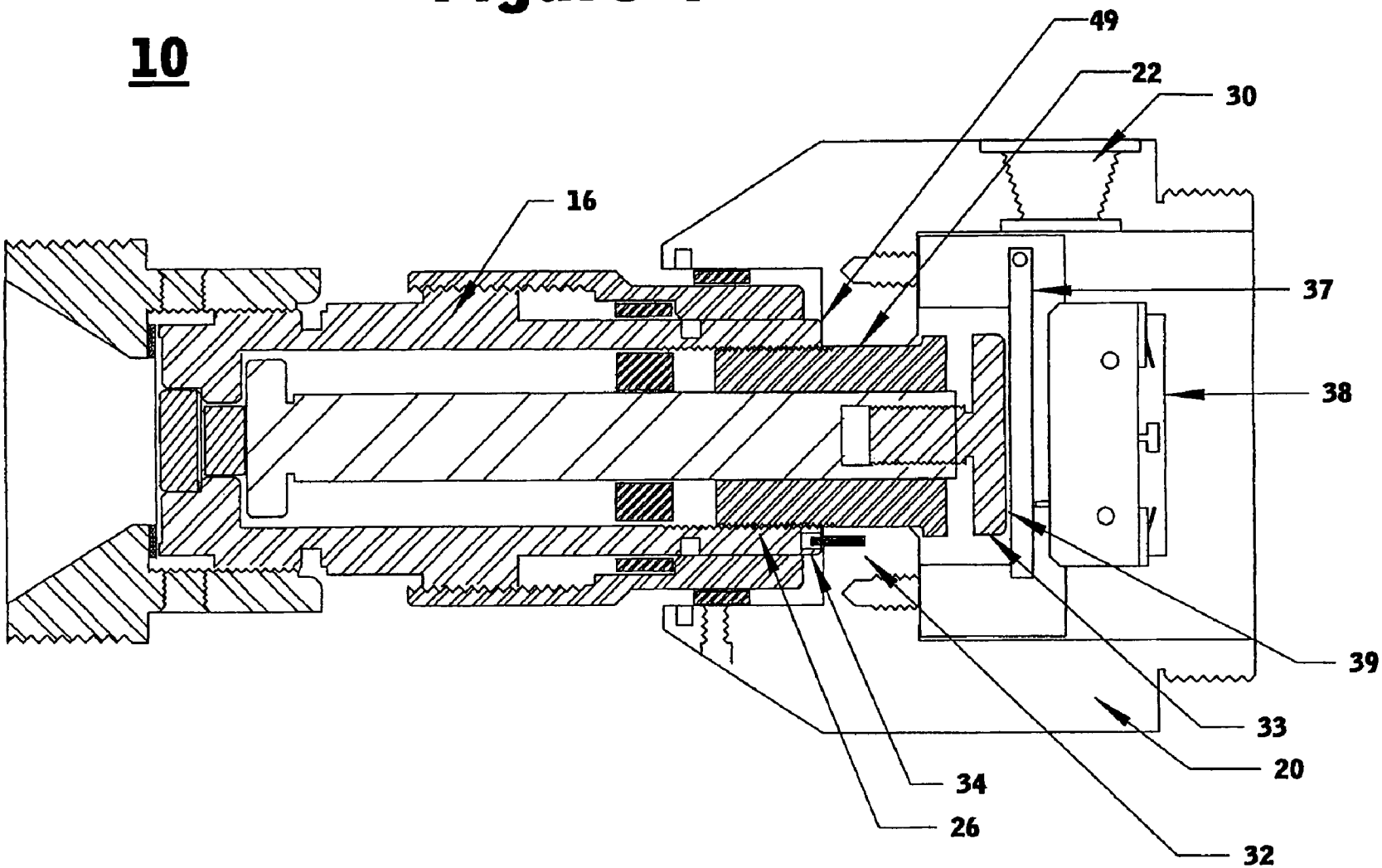
FIG. 4 is a cutaway, cross-sectional side elevational view of the present invention depicting operation of the internal micro-switch.

Referring to FIG. 4, enclosure 20 is shown in contact with body 16 at connection 49. The correct gap 39 is calibrated between trip disc 33 and trip lever 37. The switch 10 is ready to sense pressure and trip micro switch 38.

Figure 5:
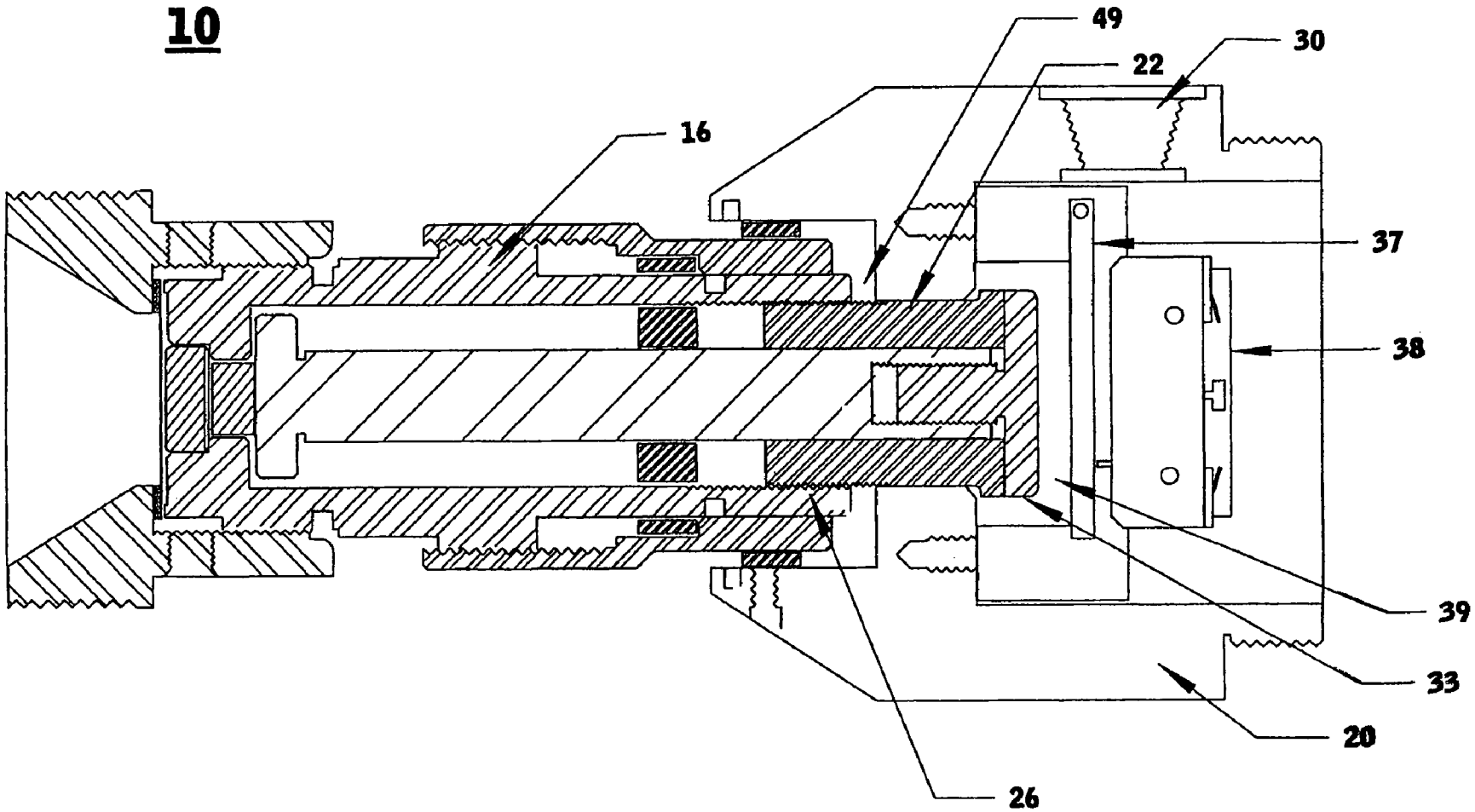
FIG. 5 is a cutaway, cross-sectional side elevational view of the present invention depicting non-operation of the internal micro-switch when the explosion-proof enclosure has shifted in position with respect to the body of the pressure switch.

Referring to FIG. 5, the present invention is shown without the rotation-proof enclosure and where excessive force was used on enclosure 20 causing body 16 to separate from retainer sleeve 22 at threaded connection 26. This separation increases the gaps at connection 49 as well as gap 39. If enclosure 20 is sufficiently moved with respect to body 16 such that micro-switch 38 is moved beyond the actuation range of trip disc 33, micro-switch 38 may not operate. In this situation, the pressure switch will not then detect any pressure condition.

Although preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized at the scope of the invention as defined and limited only by the claims that follow.

I claim:

1. A housing for a pressure switch, comprising:

a) a tubular body for enclosing an actuating mechanism for said switch, said body having upper and lower ends and a passageway extending therebetween, said lower end adapted to couple to a pipeline, said upper end defining a first opening;

b) an explosion-proof enclosure for enclosing a switch mechanism for said switch, said enclosure adapted to slidably fit onto said upper end of said body, said enclosure having a second opening that substantially aligns with said first opening when said enclosure is mounted onto said body; and c) anti-rotation means for preventing said enclosure from rotating on said body when said enclosure is fitted on said body, said anti-rotation means disposed between said enclosure and said body.

2. The housing as set forth in claim 1 further comprising a trim that is adapted for coupling said lower end of said body to said pipeline.

3. The housing as set forth in claim 1 wherein said anti-rotation means comprises at least one screw threaded into a threaded opening in said enclosure whereby said screw partially extends from said opening into a receptacle in said body and prevents said enclosure from rotating on said body.

4. The housing as set forth in claim 1 wherein said anti-rotation means comprises:

a) at least one pin passing through a third opening in said enclosure whereby said pin partially extends from said opening into a receptacle in said body and prevents said enclosure from rotating on said body; and b) means for securing said pin in said third opening.

5. The housing as set forth in claim 4 wherein said means for securing said pin is a screw or a plug inserted in said third opening to keep said pin from exiting said receptacle.

6. The housing as set forth in claim 1 wherein said anti-rotation means comprises threading said enclosure onto the upper end of said body using left-hand threads.

7. A housing for a pressure switch, comprising:

a) a tubular body for enclosing an actuating mechanism for said switch, said body having upper and lower ends and a passageway extending therebetween, said lower end adapted to couple to a pipeline, said upper end defining a first opening and having an interior sidewall, said interior sidewall having coupling means for coupling with a retainer sleeve;

b) an explosion-proof enclosure for enclosing a switch mechanism for said switch, said enclosure adapted for mounting on top of said upper end of said body, said enclosure defining a second opening that substantially aligns with said first opening when said enclosure is mounted on top of said body;

c) a retainer sleeve adapted to pass through said second opening, said sleeve having an exterior sidewall with coupling means for securely coupling with said coupling means of said first opening and for securing said enclosure to said body, said sleeve having a passageway for said actuating mechanism to extend through from said body into said enclosure; and d) anti-rotation means for preventing said enclosure from rotating on said body when said enclosure is secured to said body by said retainer sleeve, said anti-rotation means disposed between said enclosure and said body.

8. The housing as set forth in claim 7 wherein said coupling means comprises threads.

9. The housing as set forth in claim 8 wherein said threads are left-hand threads.

10. The housing as set forth in claim 7 further comprising a trim that is adapted for coupling said lower end of said body to said pipeline.

11. The housing as set forth in claim 8 wherein said anti-rotation means comprises threading said enclosure onto the upper end of said body in a direction that is opposite to the direction said retainer sleeve is threaded into the first opening of said body.

12. The housing as set forth in claim 7 wherein said anti-rotation means comprises at least one screw threaded into a threaded opening in said enclosure whereby said screw partially extends from said threaded opening into a receptacle in said body and prevents said enclosure from rotating on said body.

13. The housing as set forth in claim 7 wherein said anti-rotation means comprises:

a) at least one pin passing through a third opening in said enclosure whereby said pin partially extends from said third opening into a receptacle in said body and prevents said enclosure from rotating on said body; and b) means for securing said pin in said third opening.

14. The housing as set forth in claim 13 wherein said means for securing said pin is a screw or a plug inserted in said third opening to keep said pin from exiting said receptacle.

15. The housing as set forth in claim 7 wherein said anti-rotation means comprises at least one pin disposed between said body and said enclosure, said pin adapted to releasably seat into a receptacle whereby said enclosure is prevented from rotating on said body when said pin is seated in said receptacle.

16. The housing as set forth in claim 15 wherein said pin extends downwardly from said enclosure and said receptacle is located on said upper end of said body.

17. The housing as set forth in claim 16 wherein said receptacle comprises a slot or a hole.

18. The housing as set forth in claim 15 wherein said pin extends upwardly from said upper end of said body and said receptacle is located on a bottom surface of said enclosure.

* * * * *